United States Patent [19]

Raasch et al.

[11] 4,113,193

[45] Sep. 12, 1978

[54] METHOD AND APPARATUS FOR WINDING CONICAL COILS OR CHEESES AT CONSTANT THREAD-FEEDING VELOCITY

[75] Inventors: Hans Raasch, Munchen Gladbach; Lothar Müller, Kaarst, both of Germany

[73] Assignee: W. Schlafhorst & Co., Munchen Gladbach, Germany

[21] Appl. No.: 633,707

[22] Filed: Nov. 20, 1975

[30] Foreign Application Priority Data

Nov. 20, 1974 [DE] Fed. Rep. of Germany ..... 2454917

[51] Int. Cl.[2] ..... B65H 54/02

[52] U.S. Cl. ..... 242/18 R; 242/18 DD; 242/43 R; 242/45

[58] Field of Search ..... 242/18 R, 18 DD, 43, 242/45

[56] References Cited

U.S. PATENT DOCUMENTS

| | | | |
|---|---|---|---|
| 2,524,623 | 10/1950 | Colombu | 242/43 UX |
| 2,618,441 | 11/1952 | Marcellus | 242/45 |
| 2,950,068 | 8/1960 | Rutgers | 242/43 |
| 3,359,715 | 12/1967 | Mackie | 242/43 X |
| 3,640,477 | 2/1972 | Furst | 242/18 R |
| 4,002,306 | 1/1977 | Raasch | 242/18 R |

*Primary Examiner*—John Petrakes

*Attorney, Agent, or Firm*—Herbert L. Lerner

[57] ABSTRACT

Method of winding conical cross-wound coils at constant thread-feeding velocity, wherein varying winding speeds between the largest and smallest periphery of the coils are compensated for by filling and emptying a controlled thread storage device, which includes filling the thread storage device during a time interval wherein the thread is being guided in a three-dimensionally disposed spiral extending from a given neutral periphery of a coil to the smallest periphery thereof and back, and emptying the thread storage device during a time interval wherein the thread is being guided in a three-dimensionally disposed spiral extending from the given neutral periphery of the coil to the largest periphery thereof and back, the instantanteous length of the stored thread being varied in a wave-shaped substantially sinusoidal manner and the amplitude of the respective wave being proportional to the maximal length of the thread to be stored as required during each thread storing operation; and apparatus for performing the method.

24 Claims, 7 Drawing Figures

FIG. 6
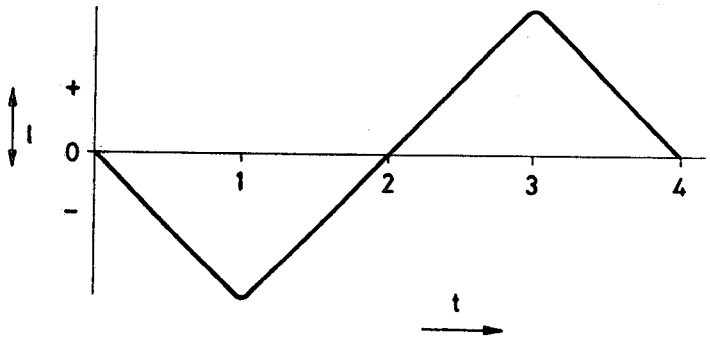
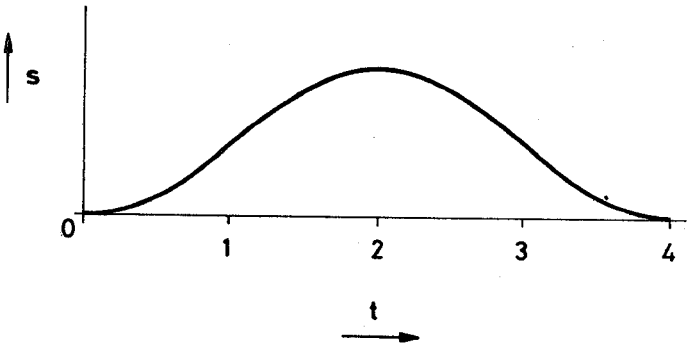
FIG. 7

METHOD AND APPARATUS FOR WINDING CONICAL COILS OR CHEESES AT CONSTANT THREAD-FEEDING VELOCITY

The invention relates to a method and apparatus for winding conical cross-wound coils or cheeses at constant thread-feeding velocity, varying winding speeds between the large and the small diameter of the conical coils being compensated for by periodically filling and emptying a controlled thread storage device.

When a conical bobbin is driven with constant peripheral velocity in a textile machine, variations in the instantaneous winding speed occur in the course of winding this coil, because the thread is wound at the narrow or wide end of the coil or in the middle of the coil, depending upon the position of the thread guiding member. The difference in the winding speed must be compensated for when the thread is fed at constant velocity, as is the case, for example, in spinning frames.

For this purpose, it has been proposed heretofore to dispose a thread storage device between the winding device and the thread supply mechanism. The winding speed is then regulated in accordance with the fullness of the storage device. Such apparatus is complicated and expensive.

It has also been proposed heretofore to use a thread storage device, the stored content of which changes periodically with the stroke or lift of the thread guide. In that known storage device, the content thereof is also controlled by the fullness of the cross wound coil or bobbin. Such thread storage devices operate with varying thread tension.

It is an object of the invention to provide a controlled, periodically filled and emptied thread storage device of the foregoing type which is improved in such a manner that the thread tension remains largely constant and that, in particular, any peaks of tension which, in the case of thin threads, can lead to breaks in the thread or other damage to the thread, are avoided.

With the foregoing and other objects in view, there is provided in accordance with the invention a method of winding conical cross-wound coils at constant thread-feeding velocity, wherein varying winding speeds between the largest and smallest periphery of the coils are compensated for by filling and emptying a controlled thread storage device, which comprises filling the thread storage device during a time interval wherein the thread is being guided in a three-dimensionally disposed spiral extending from a given neutral periphery of a coil to the smallest periphery thereof and back, and emptying the thread storage device during a time interval wherein the thread is being guided in a three-dimensionally disposed spiral extending from the given neutral periphery of the coil to the largest periphery thereof and back, the instantaneous length of the stored thread being varied in a wave-shaped substantially sinusoidal manner and the amplitude of the respective wave being proportional to the maximal length of the thread to be stored as required during each thread storing operation.

The neutral coil periphery is defined as that coil periphery precisely at which the thread length supplied by the feeding mechanism is wound onto the coil. The location of the neutral periphery on the coil depends upon the motion of the thread guiding member. This motion may be non-uniform or substantial uniform. The motion of the thread guiding member would be set at non-uniform if one wanted to decrease or increase the density of the thread winding at one coil end, for example. When the motion of the thread guiding member is substantially uniform, then the neutral coil periphery is approximately in the middle of the length of the coil.

Because the point at which the thread runs up onto the coil and, possibly with a slight phase shift also the thread guiding member travels equal distances in substantially equal times, and because on the other hand, the periphery of the conical cross-wound coil increases continuously from the smallest to the largest coil periphery, a uniform thread tension is obtained if the instantaneous value of the length of the stored thread is changed in a wave-shaped, substantially sinusoidal fashion. The maximum length of the thread to be stored as required during each storage operation decreases with increasing coil fullness from layer to layer, which has an influence on the thread tension. The fullness and the diameter of the coil are proportional to the coil periphery. If the coil is driven by rolling on a winding cylinder rotating at constant speed, then the rotary speed of the coil is inversely proportional to the periphery of the coil.

The greater the conicity or taper of the coil i.e. the greater the difference between the coil peripheries at the wide and the narrow ends of the coil, the greater is the maximum length of the thread to be stored, that is required during each storing operation. At a given rotary speed of the coil, the thread length to be stored is also dependent upon the velocity of the thread guide, which determines the thread-crossing angle.

In accordance with another feature of the invention, therefore, the maximum length of the thread to be stored, that is required during each storing operation, is made dependent directly or indirectly upon the conicity of the coil, the thread-crossing angle and the coil periphery.

The construction of the thread storage device is basically independent of the proposed method. However, it is advantageous that the thread storage device have movable thread guiding members which determine the thread storage travel distances. Therefore, in accordance with a further feature of the invention, the amplitude of the thread storage travel distance of the thread storage device, which is adjusted as a function of the conicity and the thread-crossing angle, is varied continuously in dependence upon the coil periphery. The thread storage devices are then to be moved substantially proportionally to the thread length to be stored.

In accordance with yet another feature of the invention, the thread storage device is filled and emptied in phase with the motion of the thread run-up point. The distance of the thread guiding member from the thread run-up point at the cross-wound coil is kept as small as possible.

If this distance is zero, then the thread-guiding cycle also runs in phase with the filling and emptying of the thread storage device, which facilitates the determination and dimensioning of the appropriate control cam.

If the thread takeup of the conical coil is relatively small and less than the continuous thread feed, then the thread takeup by the thread storage device is relatively large. If, on the other' hand, the thread takeup of the coil is larger than the continuous thread feed, then the thread withdrawal from the thread storage device increases accordingly. With each double stroke or life of the thread guide, the content of the thread storage device thus varies from zero value to maximum content and back to zero value.

For taking a practical advantage of the synchronized movement of the run-up point of the thread onto the coil and the thread storage device, the coil is advantageously driven by rolling on a winding cylinder, the rotary speed of which depends on the thread feeding velocity.

Attention must also be given to keeping the manufacturing costs low in the realization or practical application of the invention.

Consequently, in accordance with an additional feature of the invention, the control variables that depend upon the conicity and the thread-crossing angle are adjusted preferably centrally for a plurality or all of the winding stations of the textile machine, and the control variable which depends upon the periphery of the coil is separately determined individually for each winding station and set into the thread storage device.

The advantage of this procedure is, in particular, that a plurality or all of the winding stations are largely controlled centrally, and a separate control mechanism is provided at each winding station only if absolutely necessary. Consequently, the required amount of machinery is reduced considerably. Therefore, also this feature of the method is of particular importance.

In cross-wound coils with "wild" (random) winding, it is a disadvantage that threads of different layers always lie close together when the rotary speed of the coil and the thread guidance cycle are in an integral ratio to each other. These "pattern windings" or "ribbons" not only look unsightly, they also cause processing difficulties, for instance, in the dyeing of the coils. To avoid pattern windings, it has been known heretofore to vary the ratio of the thread guidance to the rotary speed of the winding cylinder about a fixed mean value.

In accordance with an added feature of the invention, for this purpose, synchronously with a variation of the thread-crossing angle which serves to avoid pattern windings (ribbons), the maximum value of the thread length to be stored is varied.

A reciprocating thread guide, a slotted thread guiding cylinder or a winding cylinder constructed as a thread guiding cylinder can serve as the thread guidance member.

In accordance with the apparatus for carrying out the method according to the invention, there is provided at the textile machine, a preferably centrally disposed function generator for controlling the thread storage devices of a plurality of or all the winding stations. The control unit of the function generator is advantageously constructed for a sine function. The function generator can be a crank mechanism.

In accordance with a different embodiment of the invention, the function generator has a control cam provided with control contours, and a follower device following the control contours imparts a reciprocating control movement to a control rod leading to the thread storage device or devices.

In accordance with a concomitant feature of the invention, a similar control device for the thread guiding device, which is not constructed to follow a sine function, however, is connected with the control unit of the function generator. This ensures synchronism of these devices. The control contours may be constructed, for example, as guide slots for guide rollers or slides.

Because of the large number of winding stations that must be controlled in common, the inertial forces must be kept as small as possible. Therefore, the control rods are formed preferably of light, tough materials, making use of light-weight structural sections, such as tubes, for example.

In accordance with another feature of the invention, the control cylinder of the function generator is advantageously connected on the driven side with a differential transmission, an arm of which is adjustable for changing the rotary speed. The arm is advantageously connected, for example, with a device which varies the control movements of the control rod of the thread storage device synchronously with the motion of the arm. The change must take place in the direction of decrease in the thread storage device content to increase the rotary speed, and in the direction of increase in the content to decrease the rotary speed.

Although it is advantageous to provide a common drive to a large number of winding stations, the fullness of the individual bobbin will, as a rule, be different at least after a certain time of operation. Therefore, in accordance with a further feature of the invention, an adjusting member, which is controlled directly or indirectly by the coil periphery, and varies the amplitude of the travel of the thread storage device, is advantageously disposed at each winding station. With increasing fullness of the coil, which is equivalent to increasing the coil periphery, the thread storage device travel must take place in the direction in which a decrease occurs in the content of the thread storage device.

In accordance with another embodiment of the invention, the thread storage device is constructed as a loop former with two stationary and one movable thread deflection points.

Also in accordance with an added feature of the invention, the movable thread deflection point is attached at the end of a lever arm which is pivoted about a pivot point and is disposed between the stationary deflection points. The lever arm is controlled directly or indirectly by the function generator by means of a control rod. The control excursion and thereby, the amplitude of the thread storage device travel distances can be varied by varying the pivots of the lever or linkage arrangement.

In order to obtain approximate proportionality between the thread length to be stored and the motion of the storage components of the thread storage device, in accordance with another feature of the invention, the thread storage device, constructed as a loop former, is provided with rollers at the thread deflection points, the central axes of the rollers being offset in the storage position in such a manner that a plane passing through the central axes of the outer rollers either does not intersect with the middle roller or just barely touches it. In the zero position, a thread loop already exists, and storage is accomplished by undisturbed further withdrawal of the loop.

Advantages accrue by reducing the number of different types, when all of the rollers have the same diameter. If the distance of the centers of the outer rollers corresponds to two to three times the roller diameter, the middle roller can be swung through the outer rollers for the purpose of facilitating the insertion of the thread. A larger spacing between the rollers, however, would have an adverse effect on the storing process.

Since, to start up a winding station, the position of the thread guiding member and the position of the storage device must be coordinated, there is provided in accordance with another feature of the invention, that after a change of coils or a thread break, the thread storage device is brought into the zero position, the thread to be wound is first held by an auxiliary thread guide and is taken over, after release, by the thread guiding member when the latter is moving in the direction toward the smaller periphery of the coil. Advantageously, the auxiliary thread guide holds the thread at that point along the length of the coil at which the peripheral velocity of the coil is substantially equal to the feeding velocity of the thread. Because the auxiliary thread guide is stationary, the thread is wound on a circular ring and not in the form of a three-dimensional spiral, until the auxiliary thread guide has transferred the thread to the thread guiding member.

To implement to last-mentioned process steps, in accordance with the invention, at every winding station of a textile machine, an auxiliary thread guide that can be engaged and disengaged is disposed so that, by means thereof, the thread can be directed, for starting up the winding process, to that point along the length of the coil at which the peripheral velocity of the coil is substantially equal to the feeding velocity of the thread. In the simplest case, the auxiliary thread guide is formed of a bracket with a depression therein, so that the thread slides automatically into the depression.

It is also advantageous for the thread storage device to be locked in the zero position. The locking mechanism is coupled at the same time with the disengagement mechanism of the auxiliary thread guide.

The zero position of the thread accumulator is that position from which the storage process starts. At the beginning of the winding operation the empty coil core or tube is first wound by means of the auxiliary thread guide with a few turns at that point along the length of the core or tube at which the peripheral velocity of the core or tube is substantially equal to the feeding velocity of the thread. It is not yet necessary to form a storage reserve. Only when the auxiliary thread guide is disengaged, which automatically causes the thread storage device to be engaged and which can take place only in the zero position, is the thread transferred to the movable thread guidance member per se. From this instant on, the winding process starts with crossed layers of threads.

The advantages of the invention are seen, among other things, in that uniform thread tension is maintained in winding a conical cross-wound coil, in dependence upon the thread feeding velocity and with preferably constant thread feeding velocity.

In this process, cross-wound coils with largely uniformly dense winding are produced. Uneven density of the winding, caused by uneven thread tension or pattern winding, is avoided to a large extent.

A further advantage is the common central control of many adjacent winding stations of a textile machine. Through the use of the invention, the manufacturing costs are reduced and the operating reliability is increased.

Other features which are considered as characteristic for the invention are set forth in the appended claims.

Although the invention is illustrated and described herein as method and apparatus for winding conical coils or cheeses at constant thread-feeding velocity, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings, in which:

FIG. 6 is a plot diagram showing the motion of the thread run-up point during the double stroke of the thread guide; and FIG. 7 is a plot diagram showing the filling and emptying of the thread storage device during the time interval of a double stroke of the thread guiding device.

Figure 1:
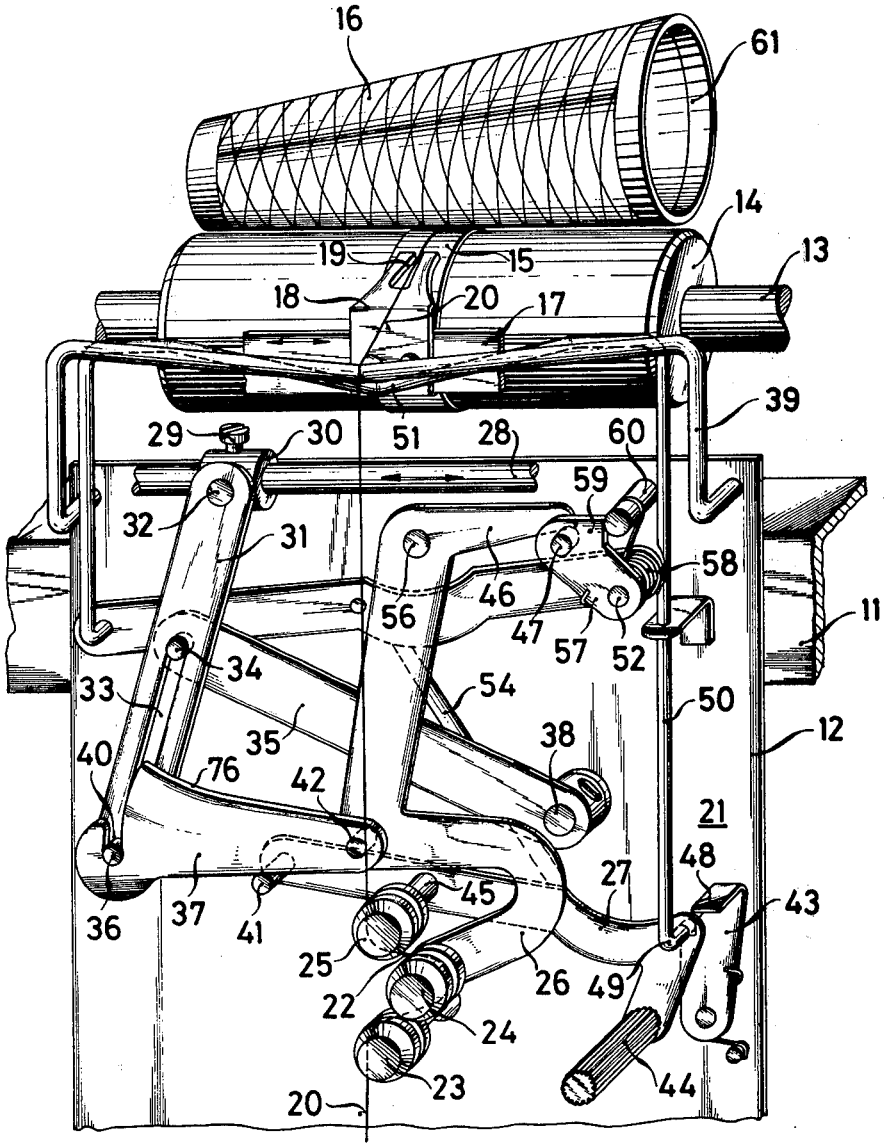
FIG. 1 is a perspective partial view of a winding station for winding conical cross-wound bobbins at constant thread-feeding velocity in accordance with the invention, shortly after the start of the winding process of the invention.
Figure 2:
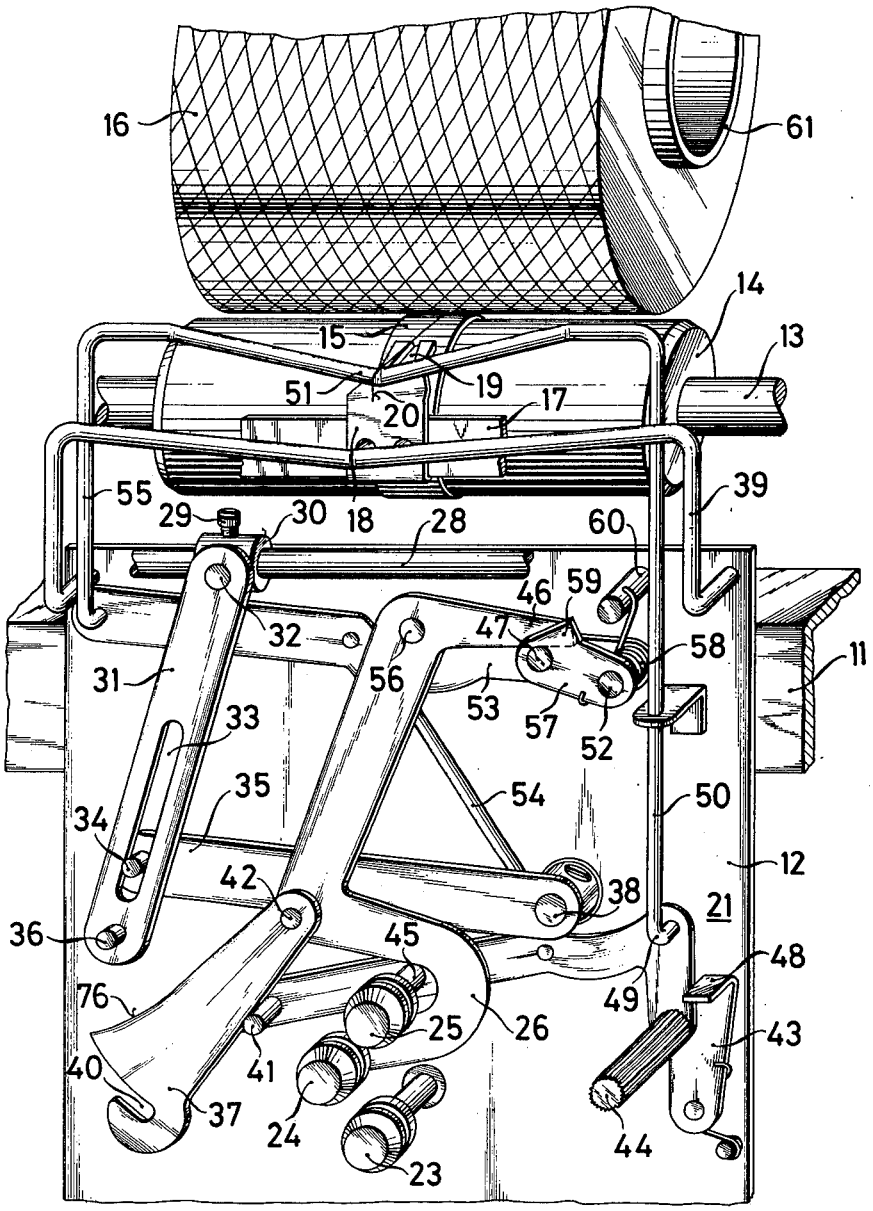
FIG. 2 is a view similar to that of FIG. 1 of the same winding station shortly after the completion of the winding process.

Referring now to the drawing and first, particularly, to FIGS. 1 and 2, there is shown therein part of a winding station of a textile machine, which includes a support beam 11 with a base plate 12 fastened thereto. A winding roller 14 is secured on a shaft 13, which extends from winding station to winding station, the winding roller 14 having, in this illustrated embodiment, in the middle thereof a zone 15 with a high coefficient of friction, which ensures that a conical cross-wound coil 16, which rolls around on this zone 15 of the winding roller 14, will be driven at the middle of the roller 14 and therefore, at the middle of the bobbin or coil.

The zone 15 with the high coefficient of friction may also be omitted in special cases. Because the driving zone is no longer defined, increased slippage must be expected between the winding roller 14 and the cross-wound coil or bobbin 16, which is not so advantageous, however, with respect to uniform thread tension and thread stress.

A centrally controlled thread guiding member 18 is movable regionally in the direction indicated by the double-headed arrow by means of a control rod 17 which extends from winding station to winding station. The thread guiding member 18 is formed with a groove 19 for receiving and guiding the thread 20 that is to be wound.

The thread 20 is fed from below continously from a non-illustrated supply mechanism, at preferably constant feed velocity.

In a thread storage device 21, the thread forms a loop 22 in that it is suitably deflected by a deflecting member 23 fastened to the base plate 12, a movable deflecting member 24 fastened to the end of the storage device lever 26 and a third stationary deflecting member 25 also fastened to the base plate 12. The deflecting members 23, 24 and 25 are constructed as easily turning rollers with thread guiding grooves machined therein.

A control rod 28, which extends from winding station to winding station controls the thread guide 21 in accordance with a sine function through reciprocating movements in the directions of the double-head arrow. By means of a screw 29, a coupling member 30 is clamped on the control rod 28. A lever 31 is pivoted on the coupling member 30 about a pivot point 32. The lever 31 is formed with a slot 33, in which a pin 34 of an adjusting member 35, constructed as an adjusting lever, engages. A pin 36 is fastened to the lower end of the lever 31.

A strap 37 transmits the movement of the lever 31, which is pivotable about the pin 34, to the storage device lever 26. By rotation of the shaft 38 and thus, by swinging the adjusting member 35 fastened on the shaft 38, the pin 34 slides in the slot 33 of the lever 31. The transmission ratio for the transmission of the motion of the control rod 28 to the storage device lever 26 is thereby changed. The storage device lever 26, the lever 31 and the strap 37 are among the storage device components of the thread storage device.

In FIG. 1, the zero position or neutral setting of the thread storage device 21 is shown. In accordance therewith, the storage device lever 26 is also in the zero position. The deflecting roller 24 fastened to the end of the storage device lever 26 is not quite tangent to the plane in which the central axes of the deflecting members 23 and 25 are both disposed. A thread loop 22 therefore exists already in the zero position. The presence of this initial loop 22 is important because then the quantity of stored thread can be built up without distortion by further drawing out this loop 22.

All of the rollers 23, 24 and 25 of the deflecting locations have the same diameter. The center-to-center distance of the deflecting rollers 23 and 25 is somewhat larger than twice the roller diameter, so that the storage device lever 26 can also be swung by hand from the zero position shown in FIG. 1 farther to the left-hand side, as viewed in FIG. 2, for easy insertion of the thread.

The respective required content of the storage device is built up by drawing the thread loop, which is already present in the zero position, more or less farther to the right-hand side, as viewed in FIG. 1, for example. The storage device content, as a good approximation, is proportional to the angle of traverse of swing of the storage device lever 26.

Because the thread 20, when the thread guide member 18 is moved to the right or left, experiences a pull at an angle between the deflecting member 25 and the cross-wound coil or bobbin 16, for which compensation must be provided, a contoured compensation wire 39, over which the thread is partially looped, is mounted on the base plate 12. The contour of the compensation wire 39 in the partially looped region is such that always the same thread length is present from the deflecting member 25 to the respective run-up point at the coil or bobbin 16 during a thread guidance cycle. As is seen from FIGS. 1, 2 and 4, the compensation wire 39 is bent outwardly somewhat in the middle thereof.

Under some conditions, the strap 37 can lose the connection thereof with the pin 36, as is shown in FIG. 2, since the slotted bearing opening 40 opens towards the top thereof.

In accordance with FIG. 1, the strap 37 is therefore prevented by a pin 41, provided at a coupling lever 27, from turning counterclockwise about a bearing pin 42 located on the storage device lever 26, so as to loosen itself from the pin 36 of the lever 31. If the releasing lever 27 is swung by means of the handle 44 counterclockwise about the pivot point 45 which serves simultaneously as the shaft for the deflecting member 25, after the lock 43 has been shifted, then the strap 37 is no longer supported and is loosened by its own weight from the pin 36, as shown in FIG. 2.

When no further external forces act upon it, the storage device lever 26 swings of its own weight into the zero position. Through the engagement of the stop arm 46 thereof with the stop pin 47, the storage device lever 26 is accordingly held in the zero position, while the lever 31 can freely swing back and forth.

The coupling lever 27 is limited in both of the end positions thereof by the lock 43. A tab 48 of the lock 43 comes to rest in the engaged position of the coupling lever against a bent end 49 of an auxiliary thread guide 50, which is also connected to the coupling lever 27. In the disengaged position of the coupling lever 27, the tab 48 comes to rest against the vertical part of the coupling lever 27, as viewed in FIG. 2, and thus holds the coupling lever 27 in the respective position.

The auxiliary thread guide 50, in the middle of the thread path or run, is formed with a saddle-like depression 51, into which the thread slides automatically as soon as the thread guide 50 is raised, as shown in FIG. 2. For raising and lowering, the thread guide 50 is provided with parallel guidance which is formed of a lever 53 pivotable about a pin 52, and a guide rod 54 articulatingly linked to the lever 53 and the coupling lever 27. The one end 55 of the auxiliary thread guide 50 is articulatingly connected to the end of the lever 53. Since the other end of the auxiliary thread guide 50 is also connected to the coupling lever 27, the auxiliary thread guide 50 is raised automatically to a location above the thread guiding member 18, the moment the coupling lever 27 is manually disengaged, as shown in FIG. 2. In the process, the auxiliary thread guide 50 takes over the thread from the thread guiding member 18 which in the embodiment of the instant application, is a reciprocating thread guide, but could also be a rotating thread guide.

As may be seen from FIGS. 1 and 2 and as has been mentioned hereinbefore, the storage device lever 26, which is pivotable about the pin 56, has a zero position stop which is formed of a stop strap 57 which is pivotable about the pin 52, and a stop pin 47 which is fastened on the stop strap 57 and against which the stop arm 46 of the storage device lever 26 comes to rest.

Since the stop strap 57 is held in the position thereof solely by a coiled torsion spring 58 so that it is drawn with a projection 59 thereof against the pin 60 fastened to the base plate 12, the storage device lever 26 can be moved manually from the zero position farther toward the left-hand side, as viewed in FIG. 2, after overcoming the biasing spring force of the coiled torsion spring 58. Of course, this is possible only in the disengaged condition.

As can be seen in FIG. 2 of the drawing, the conical cross-wound coil or bobbin 16 has just become fully wound. The thread storage device 21 is disengaged and the auxiliary thread guide 50 is raised. In this position of FIG. 2, coil or bobbin exchange or the tying or splicing of the thread occurs.

Figure 4:
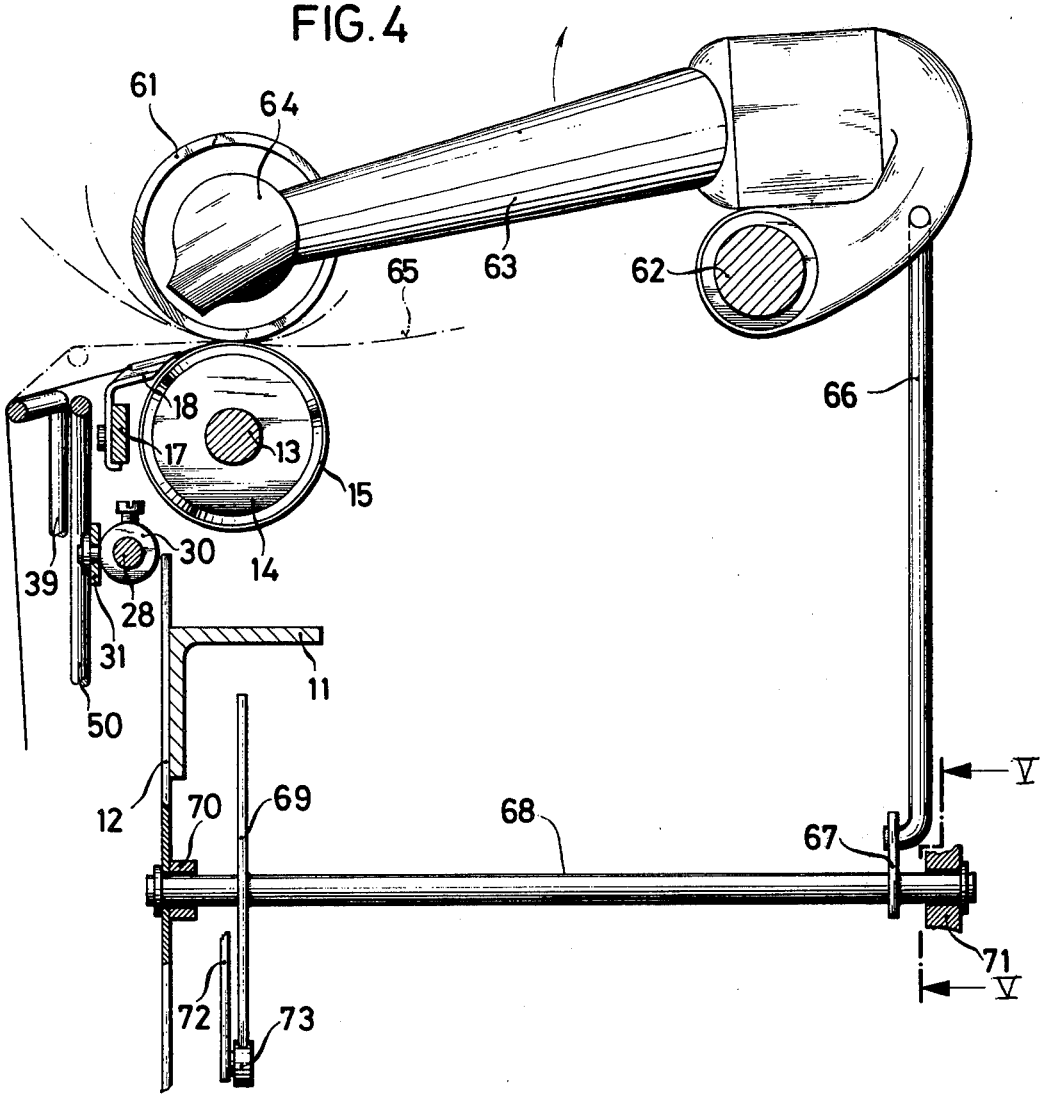
FIG. 4 is a diagrammatic, simplified cross-sectional view of the winding station.

The tube or core 61 of the cross-wound coil or bobbin 16 is held in a conventional manner, according to FIG. 4, by a coil holder 63 which is pivotable about a shaft 62 and carries at an end thereof a readily moving and rotatably mounted core-receiving device 64.

The particular shape of the core holder 63 brings about an automatic weight compensation with increasing winding of the coil, so that the compressive pressure of the coil against the winding roller 14 remains substantially the same.

The bobbin tube 61 held by the tube or core receiving device 64 rolls around on the zone 15 of the winding roller 14. As the winding grows, the coil finally assumes the peripheral contour 65.

With increasing coil periphery, the coil holder 63 swings upwardly in direction of the curved arrow, shown in FIG. 4. Since the coil periphery is a measure of the quantity of stored thread, the swinging motion of the bobbin holder 63 is utilized in the present case in the following manner for varying the amplitude of the pendulum swing of the storage device lever 26.

Figure 5:
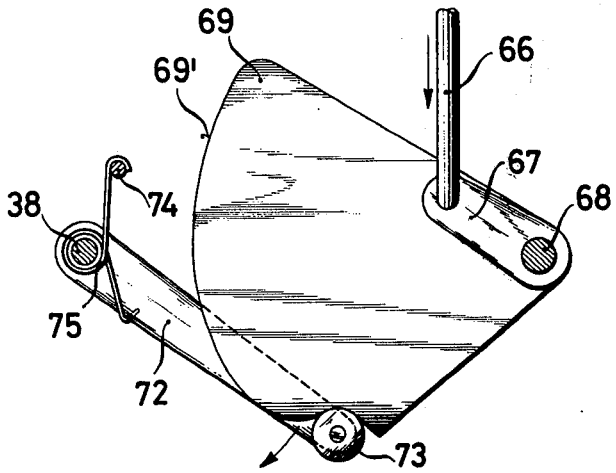
FIG. 5 is a fragmentary partly sectional view of FIG. 4, taken along the line V — V in the direction of the arrows.

The angular position of the coil holder 63 is transmitted through the tie rod 66 which is articulatingly connected to the coil holder 63 to a lever 67 which is firmly connected to a shaft 68, as is shown in FIGS. 4 and 5. A cam 69 is also connected firmly to the shaft 68. The contour of the cam 69 can be seen in the side view shown in FIG. 5. The shaft 68 is supported in two bearings. The one bearing 70 is located in the base plate 12 and the other bearing 71 in the not otherwise illustrated machine frame, behind the base plate 12.

The shaft 38, which can also be seen in FIGS. 1 and 2, extends through the base plate 12 and carries a lever 72 to the rear of the base plate 12, a roller 73 being rotatably mounted at the end of the lever 72.

Under the action of a coiled torsion spring 75, which is braced against the pin 74 and against the lever 72, the roller 73 is pressed resiliently against the contour 69′ of the cam 69.

With increasing fullness of the coil, the tie rod 66 moves downwardly in the direction of the arrow associated therewith in FIG. 5. The shaft 68 and the cam 69 connected therewith, are rotated accordingly. The cam 69 transmits the rotary motion thereof to the lever 72 which is deflected clockwise in the direction of the curved arrow associated therewith in FIG. 5 and accordingly turns the shaft 38 to which, according to FIGS. 1 and 2, the adjusting lever 35 is attached, which changes the pivot point about which the lever 31 turns.

In this manner, the pendulum swing of the storage device lever 26 is changed with increasing coil periphery in the sense of a reduction in the content of the storage device.

The contour of the cam 69 is either determined experimentally or calculated from the dimensions of the coil, the stroke of the thread guide, the crossing angle of the thread layers, the apex angle of the conical coil and the dimensions of the structure.

During normal operation, a new coil core or tube is inserted after a coil change, the thread coming from the supply mechanism being placed around the deflecting members 23, 24 and 25 and over the auxiliary thread guide 50 and secured to the coil core or tube. Referring to FIG. 2, the start of the cross-winding process is initiated by manually pulling the lock 43 to one side. The tab 48 thereby releases the coupling lever 27, which then attempts, due to its own weight and the weight of the parts connected therewith, to lift the latch 37 so far by means of the pin 41 that the pin 36 of the lever 31 can slide into the bearing opening 40 of the latch 37. This can occur only if the pin 36 has reached the end position thereof on the left-hand side of FIG. 2, however, which is the case in the zero position. The specially formed contour 76 of the latch 37, which is accommodated to the swinging motion of the pin 36, prevents the latch 37 from hooking onto the pin 36 in any position than the zero position.

As long as the thread storage device 21 is not engaged, the thread runs up at the center of the coil due to the particular form of the auxiliary thread guide 50. In this position, as aforementioned, the coil takes up exactly the amount of thread that is supplied by the feed mechanism. After one stroke of the thread guide at the longest, the pin 36 has reached the end position thereof at the left-hand side of FIG. 2, the latch 37 snaps in and the auxiliary thread guide 50 drops into its lower end position.

Accordingly, the thread 20 comes into the vicinity of the thread guiding member 18, which is at the same moment also just in the center of the coil and then continues to travel toward the small diameter end of the coil. The thread 20 is caught in the groove 19 of the thread guiding member 18. The thread guidance and the content of the storage device are accordingly synchronized.

Figure 3:
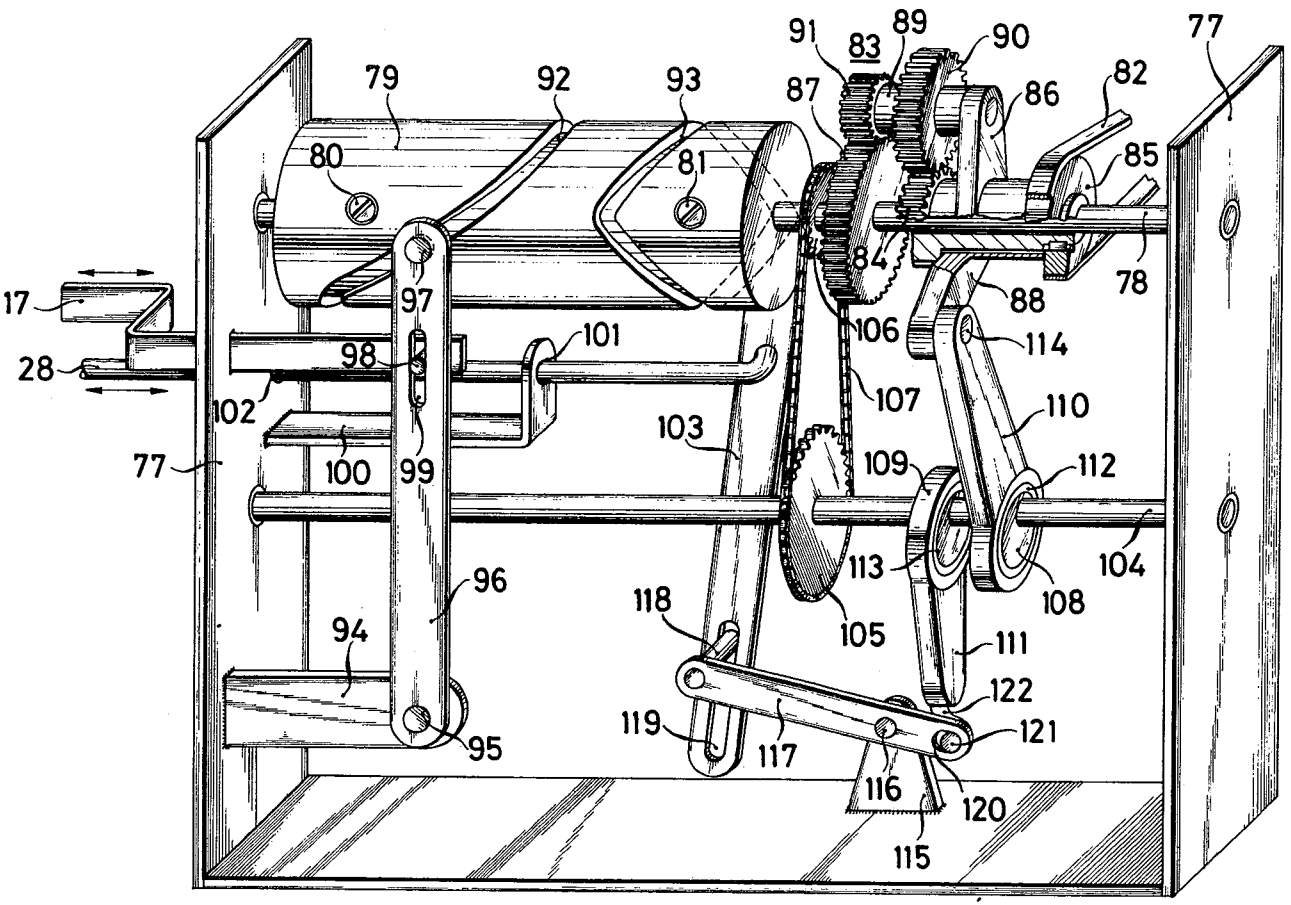
FIG. 3 is a perspective view of a part of the control unit according to the invention.

Since the control rods 17 and 28 are controlled jointly for several or all winding stations, the drive and control mechanism shown in FIG. 3 is located at one end of the textile machine.

A control cylinder 79 is fastened by means of screws 80 and 81 on a shaft 78 mounted on bearings in the machine frame 77. The shaft 78 is driven at a mean constant speed through a belt 82 by a non-illustrated electric motor, with a differential transmission 83 interposed.

The differential 83 is formed of a gear pair, rotatably mounted centrally on the shaft 78, with a gear 84 and a belt pulley 85, an arm 86 which is rotatable about the shaft axis independently of the rotary speed of the gear pair, and a central output gear 87, which is firmly connected to the shaft 78.

The arm 86 has an adjusting lever 88. At the end of the arm 86, a further gear pair 89 is rotatably supported, and includes a larger gear 90 meshing with the gear 84 and a smaller gear 91 meshing with the central output gear 87.

The control cylinder 79 has two separate guide slots 92 and 93, formed therein which extend around the periphery in a closed curve.

At the wall on the left-hand side of the machine frame 77, as shown in FIG. 3, a pin 95, about which a control lever 96 can pivot, is fastened on a bracket 94. A guide roller 97, which turns easily and is attached to the end of the control lever 96, engages in the guide slot 92. A slider 98, fastened to the control rod 17, is guided in a slot 99 formed in the control lever 96. When the control cylinder 79 rotates, the control lever 96 is forced to execute an oscillating movement, so that the control rod 17, which controls the thread guiding member at several or all of the winding stations of the textile machine, is shifted back and forth in the directions of the double-headed arrows. The guide slot 92, the bracket 94 and the control lever 96 are parts of the control unit for the thread guiding device 18.

Likewise, at the wall on the left-hand side of the machine frame 77, as viewed in FIG. 3, an angle bracket 100 is attached, and has a hole 101 which, together with a hole 102 formed in the machine frame, serves to guide the control bar 28 in a straight line. The end of the control bar 28 is bent at an angle and suspended from a control lever 103 which, similarly to the control lever 96, carries at an end thereof a guide roller, which is not visible in FIG. 3, as it engages in a guide slot 93 on the rear side of the control cylinder 79. The guide slot 93 has contours such that a sinusoidal motion occurs at the control lever 103 and the control bar 28 when the control cylinder 79 rotates. In conjunction with the control cylinder 79 and the control lever 103, the guide slot 93 therefore serves as a sine-function generator for the control rod 28 and therefore, for the thread storage device 21 which, according to FIGS. 1 and 2, is controlled by the control rod 28.

An eccentric shaft 104 is likewise supported in the machine frame 77, and is driven by a sprocket wheel 105, which is connected by a link chain 107 with a second sprocket wheel 106 mounted on the shaft 78. Two eccentrics 108 and 109 are also connected firmly with the eccentric shaft 104. Two bearing sleeves 112 and 113 provided with one-arm levers 110 and 111 are disposed rotatably on the eccentrics 108 and 109. The lever 110 is articulatingly connected with the adjusting lever 88 of the arm 86 by means of the pin 114. Due to this connection, when the eccentric shaft 104 rotates, the arm 86 is turned forward and back, relative to the central axis of the shaft 78, in radial direction through a given angle for each revolution of the eccentric shaft.

The transmission ratios of the individual gears of the differential transmission 83 and the other dimensions of the parts connected with the shafts 78 and 104 are chosen so that, when the arm 86 is rotated in the drive direction, the rotary speed of the control cylinder 79 lags somewhat behind the mean rotary speed and vice versa leads somewhat when the arm 86 is rotated opposite to the drive direction.

Since the continuous variation of the speed of rotation of the control cylinder by the controlled differential transmission 83 leads to a continuous change of the crossing angle of the thread layers, and the required storage device content is changed continuously for this reason, compensation by a corresponding change of the control motion of the control rod 28 is necessary. This is accomplished in the following manner:

At the bottom of the machine frame 77, a bracket 115 is attached which has a pivot point 116 about which the two-arm lever 117 can rotate. At the end of the lever 117 toward the left-hand side of FIG. 3, a slide member 118 is attached which engages in a slot 119 of the control lever 103.

The other end of the lever 117 is formed with a slot 120, with which a slider 121 of a universal coupling 122 engages. The universal coupling 122 is attached to a lever 111.

Due to the eccentric support of the lever 111, when the eccentric shaft 104 rotates, the lever 117 executes oscillating motions, by which the pivot point of the control lever 103, determined by the slider 114, is changed. The change of the pivot point of the lever 103 takes place in a direction such that for leading rotary speed of the control cylinder 79 i.e., for increasing thread crossing angles, the amount of thread to be stored becomes smaller, and for lagging speed, larger. The slider 118 must therefore be moved upwardly for leading rotary speed and downwardly for lagging rotary speed, so that the control motion of the control rod 28 of the thread storage device 21 is changed accordingly.

During one cycle of the thread guiding member 18, away from the zero position to the end position at the left-hand side, from there, through the center of the coil to the end position at the right-hand side and back to the zero position, as viewed in FIG. 3, the thread storage device 21 is filled and emptied in the following manner:

During the movement of the thread run-up point from the neutral to smallest coil periphery, the storage device lever 26 swings to the right-hand side and thereby lengthens the thread loop, the content of which comes from the nonillustrated thread feeding mechanism. During the return of the thread run-up point from the smallest to the neutral coil periphery, the storage device lever 26 swings still further to the right-hand side up to the end position thereof which is matched to the respective coil periphery. The thread storage device then has the largest content relative to the respective thread position.

During the movement of the thread run-up point from the neutral to the largest coil periphery and back, the storage device lever 26 also swings back to the starting position thereof. The stored amount of thread of the previously lengthened thread loop is at the same time wound on the cross-wound coil. The aforedescribed filling and emptying process is repeated from thread layer to thread layer.

In FIG. 6, the movement of the run-up point of the thread during a double stroke of the thread guide is shown graphically. Along the abscissa, the time $t$ is plotted, starting and ending with an instant when the run-up point of the thread touches the neutral periphery of the coil. Along the ordinate, the coil length is plotted, $-1$ denoting the narrower and $+1$ the wider end of the coil.

The thread run-up point travels from the neutral periphery with uniform velocity to the smallest coil periphery, where the movement is delayed or retarded and the direction of motion reversed. After a brief acceleration, the thread run-up point travels with uniform velocity beyond the neutral coil periphery to the largest coil periphery, where the movement is again retarded and the direction of motion is again reversed. After a brief acceleration, the thread run-up point again travels with uniform velocity in the direction toward the smallest coil periphery.

The instant the neutral periphery is reached in the course of this movement, one double stroke of the thread guide is completed.

In the same time interval, wherein the thread guide executes one double stroke, the thread storage device 21 is filled and emptied in accordance with the graphical presentation in FIG. 7.

In the plot diagram of FIG. 7, the time $t$ of a filling and emptying operation is plotted along the abscissa. The length $s$ of the stored thread is plotted along the ordinate.

At the time zero, when the thread run-up point touches the neutral periphery of the coil, the storage process begins in accordance with a sine function. At time 1, when the thread run-up point touches the smallest bobbin circumference, the thread takeup by the storage device is greatest. At time 2, when the thread run-up point again touches the neutral periphery on the way to the largest coil periphery, the length of the stored thread is the greatest; the storing ceases and the storage device begins to empty. At time 3, when the thread run-up point touches the largest coil periphery, the payout of thread by the storage device is greatest. At time 4, when the thread run-up point again touches the neutral periphery of the coil on the way to the smallest coil periphery, the emptying of the storage device ceases and a new filling operation begins. The filling and emptying of the thread storage device take place approximately sinusoidally.

When the thread is guided nonuniformly, deviating from the plot diagram according to FIG. 6, the curve for the filling and emptying of the thread storage device also deviates more or less from the sine curve shown in FIG. 7.

The invention, of course, is not limited to the specific embodiment described and illustrated. As mentioned, hereinbefore, other embodiments are also conceivable within the scope of the claims and the specification. For example, the guide slots of the control cylinder 79 can also be replaced by different control contours. Also, the individual linkage arrangements and transmissions provide opporunities for numerous possible variations.

There is claimed:

1. Method of winding conical cross-wound coils at constant thread-feeding velocity, wherein varying winding speeds between the largest and smallest periphery of the coils are compensated for by filling and emptying a controlled thread storage device, which comprises filling the thread storage device during a time interval wherein the thread is being guided in a three-dimensionally disposed spiral extending from a given neutral periphery of a coil to the smallest periphery thereof and back, and emptying the thread storage device during a time interval wherein the thread is being guided in a three-dimensionally disposed spiral extending from the given neutral periphery of the coil to the largest periphery thereof and back, the instantaneous length of the stored thread being varied in a wave-shaped substantially sinusoidal manner and the amplitude of the respective wave being proportional to the maximal length of the thread to be stored as required during each thread storing operation.

2. Method according to claim 1 which comprises making the maximal length of the thread to be stored, as required during each storage operation, dependent upon the conicity of the coil, the thread crossing angle and the coil periphery.

3. Method according to claim 2 which comprises continuously varying as a function of the coil periphery the amplitude of the thread storage path of the thread storage device which is adjusted in accordance with the conicity and the thread crossing angle.

4. Method according to claim 3 which comprises moving the thread storage members substantially proportionally to the thread length to be stored.

5. Method according to claim 4 which comprises filling and emptying the thread storage device in phase with the movement of the thread run-up point on the coil.

6. Method according to claim 5 which comprises determining and feeding into the thread storage device for a plurality of the winding stations of the textile machine simultaneously the control variables depending upon the conicity of the coil and the thread crossing angle, and determining and feeding into the thread storage device individually and separately for each winding station the control variables depending upon the periphery of the coil.

7. Method according to claim 6 which comprises varying the maximal value of the thread length to be stored in the thread storing device in synchronism with a variation of the thread crossing angle serving to avoid pattern windings (ribbons).

8. Method according to claim 7 which comprises bringing the thread storage device into zero position after a thread break or a change of coils has occurred, initially holding the thread to be wound by an auxiliary thread guide, releasing the thread therefrom and taking over the thread by a thread guidance member moving in direction toward the smallest periphery of a coil being wound, and simultaneously beginning the thread storing process again.

9. Method according to claim 8 which includes holding the thread with the auxiliary thread guide at a location along the length of the coil being wound at which the peripheral velocity of the coil is substantially equal to the velocity of feed of the thread.

10. In an apparatus for carrying out a method of winding rotary conical cross-wound coils at constant thread-feeding velocity, means for winding a thread onto the coils, means for feeding the thread to said winding means, a thread storage device disposed at respective winding stations of a textile machine and controllably filled with thread and emptied thereof to compensate for varying winding speeds between the largest and smallest periphery of the coils, and a function generator in the form of a rotary control cylinder located at the textile machine and means in engagement with said cylinder cooperatively connected to the thread storage devices of a plurality of the winding stations for controlling the same.

11. Apparatus according to claim 10 wherein said rotary control cylinder includes contours for controlling said plurality of thread storage devices, said contours being dimensioned according to a sine function.

12. Apparatus according to claim 10 wherein said function generator is a crank mechanism.

13. In an apparatus for carrying out a method of winding rotary conical cross-wound coils at constant thread-feeding velocity, means for winding a thread onto the coils, means for feeding the thread to said winding means, a thread storage device disposed at respective winding stations of a textile machine and controllably filled with thread and emptied thereof to compensate for varying winding speeds between the largest and smallest periphery of the coils, and a function generator located at the textile machine and cooperatively connected to the thread storage devices of a plurality of the winding stations for controlling the same, said function generator includes means for controlling said plurality of thread storage devices, said control means being dimensioned according to a sine function, said function generator includes a rotary control cylinder having control contours thereon, a control rod extending from adjacent said rotary control cylinder to said thread storage device, follower means connected to said control rod, said follower means being in following engagement with said control contours for transmitting therefrom a reciprocating control motion to said control rod.

14. Apparatus according to claim 13 including a thread guiding device for guiding the thread from said thread storage device onto the coils, a control device for said thread guiding device having a construction other than for a sine function and connected to said control means of said function generator.

15. Apparatus according to claim 14 including a differential transmission having an arm adjustable for changing the rotary speed, said control cylinder being connected on the driven side thereof with said differential transmission.

16. Apparatus according to claim 15 wherein said arm of said differential transmission is connected to a device for varying the control movements of said control rod of said thread storage device in synchronism with the movement of said arm.

17. In an apparatus for carrying out a method of winding rotary conical cross-wound coils at constant thread-feeding velocity, means for winding a thread onto the coils, means for feeding the thread to said winding means, a thread storage device disposed at respective winding stations of a textile machine and controllably filled with thread and emptied thereof to compensate for varying winding speeds between the largest and smallest periphery of the coils, and a function generator located at the textile machine and cooperatively connected to the thread storage devices of a plurality of the winding stations for controlling the same, an adjusting member located at the respective winding stations of the textile machine, means for transmitting motion from said function generator to said thread storage device, said adjusting member being in controlling engagement at one end thereof with said means for transmitting motion, and means for pivoting said adjustment member at the other end thereof in accordance with a change in the fullness of the coil, to change the distance of travel of components of said thread storage device.

18. Apparatus according to claim 17 wherein said thread storage device is contructed as a thread loop former having respective rollers at three deflection locations thereof, said rollers having respective central axes that are offset with respect to one another in zero storage position of said thread storage device so that a plane, in which the axes of the two outer rollers are disposed, at most barely engages the peripheral surface of the middle roller.

19. Apparatus according to claim 18 wherin all of said rollers have the same diameter, and the distance between the centers of said two outer rollers is equal to from two to three times the roller diameter.

20. In an apparatus for carrying out a method of winding rotary conical cross-wound coils at constant thread-feeding velocity, means for winding a thread onto the coils, means for feeding the thread to said winding means, a thread storage device disposed at respective winding stations of a textile machine and controllably filled with thread and emptied thereof to compensate for varying winding speeds between the largest and smallest periphery of the coils, and a function generator located at the textile machine and cooperatively connected to the thread storage devices of a plurality of the winding stations for controlling the same and an engageable and disengageable auxiliary thread guide at the respective winding stations of the textile machine, having means for directing the thread, at start-up of the winding of a coil to a location along the length of the coil at which the peripheral velocity of the coil is substantially equal to the velocity of feed of the thread.

21. Apparatus according to claim 20 wherein said auxiliary thread guide is formed of a saddle-shaped bracket formed with a depression.

22. Apparatus according to claim 20 wherein said thread storage device is lockable in zero position thereof.

23. Apparatus according to claim 22 including mechanism for disengaging said auxiliary thread guide, and means for locking said thread storage device in said zero position thereof, said locking means being coupled with said disengaging mechanism.

24. In an apparatus for carrying out a method of winding rotary conical cross-wound coils at constant thread-feeding velocity, means for winding a thread onto the coils, means for feeding the thread to said winding means, a thread storage device disposed at respective winding stations of a textile machine and controllably filled with thread and emptied thereof to compensate for varying winding speeds between the largest and smallest periphery of the coils, and a function generator located at the textile machine and cooperatively connected to the thread storage devices of a plurality of the winding stations for controlling the same, including a compensating wire disposed intermediate the thread storage device and said thread feeding means for compensating for the angle at which the thread approaches said thread feeding means.

* * * * *